US010344968B2

(12) United States Patent
Huang et al.

(10) Patent No.: US 10,344,968 B2
(45) Date of Patent: Jul. 9, 2019

(54) GAS MIXER

(71) Applicant: GRAND MATE CO., LTD., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Yen-Jen Yeh, Taichung (TW); Wei-Long Chen, Taichung (TW); Kuan-Chou Lin, Taichung (TW); Tang-Yuan Luo, Taichung (TW)

(73) Assignee: GRAND MATE CO., LTD., Taichung (TW)

( * ) Notice: Subject to any disclaimer, the term of this patent is extended or adjusted under 35 U.S.C. 154(b) by 278 days.

(21) Appl. No.: 15/587,933

(22) Filed: May 5, 2017

(65) Prior Publication Data

US 2018/0320892 A1 Nov. 8, 2018

(51) Int. Cl.
*F23D 14/02* (2006.01)
*F23D 14/64* (2006.01)
*F23D 14/70* (2006.01)

(52) U.S. Cl.
CPC ..... *F23D 14/02* (2013.01); *F23D 14/64* (2013.01); *F23D 14/70* (2013.01); *F23D 2203/007* (2013.01)

(58) Field of Classification Search
CPC ..... F23D 14/02; F23D 14/64; F23D 14/70; F23D 14/34; F23D 2203/007
USPC ..... 431/354, 12
IPC ..... F23D 14/02,14/64, 14/70, 14/34
See application file for complete search history.

(56) References Cited

U.S. PATENT DOCUMENTS 2,911,035 A * 11/1959 Nieman ..... F23D 14/82 239/423
3,869,243 A * 3/1975 Creuz ..... F23D 14/60 126/285 R
4,396,372 A * 8/1983 Matumoto ..... F23D 11/448 219/206
6,537,064 B1 * 3/2003 Anderson ..... F23D 14/62 239/432

(Continued)

FOREIGN PATENT DOCUMENTS

JP 58160728 A * 9/1983 ..... F23D 14/02
JP 60020010 A * 2/1985

(Continued)

*Primary Examiner* — Gregory L Huson
*Assistant Examiner* — Daniel E Namay
(74) *Attorney, Agent, or Firm* — Muncy, Geissler, Olds & Lowe, P.C.

(57) ABSTRACT

A gas mixer includes a flow splitter and a base having an inlet portion and a mixing portion. The inlet portion has an air inlet, an air chamber, an at least one gas inlet, and an opening, communicating with each other. The air chamber has two opposite walls, which are inclined, and a distance therebetween gradually decreases from the air inlet to the opening. The gas inlet is located on one of the walls. The mixing portion has a mixing chamber communicating with the opening and a burner, respectively. The flow splitter is provided in the air chamber and located between the gas inlet and the air inlet. The flow splitter has at least one through hole facing one of the walls. Therefore, air and gas could be effectively premixed and outputted to the burner, whereby to accurately control the air-fuel ratio to enhance the combustion efficiency of the burner.

18 Claims, 12 Drawing Sheets

(56) References Cited

U.S. PATENT DOCUMENTS

| | | | | |
|---|---|---|---|---|
| 6,921,261 | B2 * | 7/2005 | Perry | F23D 14/64 126/110 C |
| 8,418,661 | B2 * | 4/2013 | Kanda | F23D 14/04 122/31.1 |
| 8,827,693 | B2 * | 9/2014 | Akagi | F23D 14/62 431/326 |
| 2007/0099134 | A1 * | 5/2007 | Hamada | F23N 1/022 431/12 |
| 2007/0251467 | A1 * | 11/2007 | Xie | F23D 14/085 122/14.31 |
| 2011/0165300 | A1 * | 7/2011 | Roychoudhury | F23C 13/00 426/523 |
| 2013/0095441 | A1 * | 4/2013 | Akagi | F23D 14/62 431/354 |
| 2013/0189630 | A1 * | 7/2013 | Ching | F23D 5/04 431/12 |
| 2013/0213378 | A1 * | 8/2013 | Schultz | F24H 3/08 126/110 C |
| 2014/0165991 | A1 * | 6/2014 | Noman | F24H 9/0068 126/116 A |
| 2015/0132703 | A1 * | 5/2015 | Noman | F23D 14/04 431/8 |

FOREIGN PATENT DOCUMENTS

| | | | | |
|---|---|---|---|---|
| JP | 63054510 | A | * | 3/1988 |
| JP | 03067916 | A | * | 3/1991 |
| JP | 2007225267 | A | * | 9/2007 |
| JP | 2010175200 | A | | 8/2010 |
| TW | M391081 | U1 | | 10/2010 |
| TW | 201040466 | A1 | | 11/2010 |
| WO | 2015001438 | A1 | | 1/2015 |

* cited by examiner

GAS MIXER

BACKGROUND OF THE INVENTION

1. Technical Field

The present invention relates to a burner for a gas apparatus, and more particularly to a gas mixer, which is adapted to mix gas and air.

2. Description of Related Art

A conventional atmospheric gas burner is provided with a nozzle at the inlet of the burner. When gas is outputted from the nozzle, a low pressure is created around the nozzle, drawing primary air into the burner to be mixed with gas. Igniting the mixed gas outputted from the flame holes of the burner can create flames. While the flames are burning, secondary air is further drawn around the flames for combustion. There is another type of gas burner called fully premixed type, which uses a blower to draw air into the burner for the mixture, and the mixed air and gas are outputted from flame holes of the burner.

A fully premixed gas burner mixes air and gas with a mixing pipe, which utilizes the principle of Venturi tube to mix airflow and gas flow in the pipe. Although the combustion efficiency of a fully premixed gas burner is higher than that of an atmospheric gas burner, the mixing effect of the mixing pipe is difficult to control. In addition, the length of the mixing pipe is usually short, and airflow and gas flow cannot be evenly mixed within such a limited traveling distance, hindering the combustion efficiency of the burner from being further improved.

BRIEF SUMMARY OF THE INVENTION

In view of the above, the primary objective of the present invention is to provide a gas mixer, which could evenly mix air and gas.

To achieve the objective of the present invention, the present invention provides a gas mixer, which is adapted to communicate with at least one burner, wherein the gas mixer includes a base and a flow splitter. The base has an inlet portion and a mixing portion, wherein the inlet portion has an air inlet, an air chamber, at least one gas inlet, and an opening, which communicate with each other. The air chamber is located between the air inlet and the opening, and has two opposite walls. The walls are inclined, and a distance between the walls gradually decreases in a direction from the air inlet to the opening. The gas inlet is located on one of the walls. The mixing portion has a mixing chamber communicating with the opening, and is also adapted to communicate with the burner. The flow splitter is provided in the air chamber and located between the gas inlet and the air inlet, wherein the flow splitter divides the air chamber into a first space and a second space. The first space communicates with the air inlet, and the second space communicates with the opening and the gas inlet. The flow splitter has at least one through hole facing one of the walls, and the first space communicates with the second space through the at least one through hole.

With the aforementioned design, gas and air could be mixed more evenly, enhancing the combustion efficiency of the burner.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
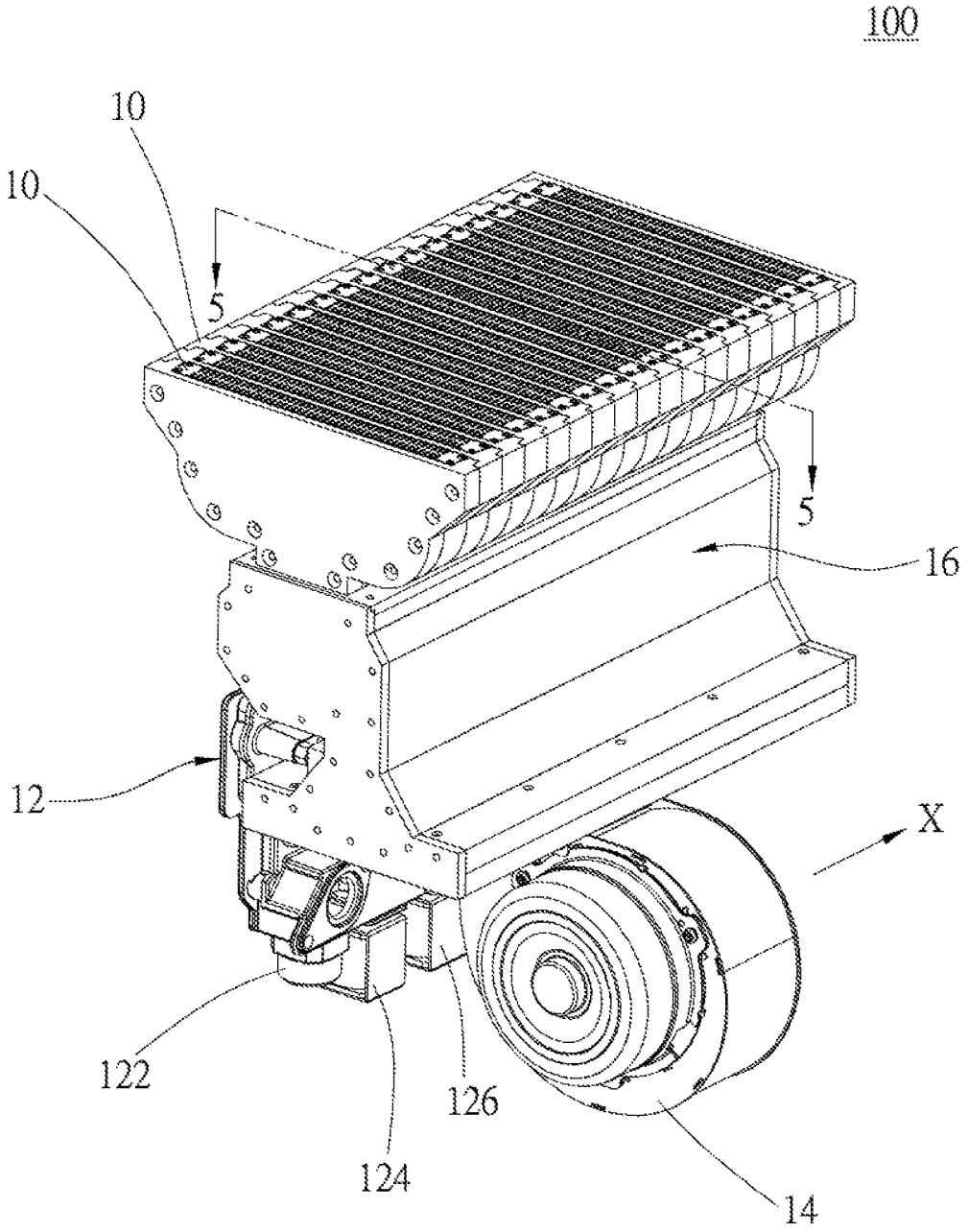
FIG. 1 is a perspective view of the gas burning device of a first embodiment of the present invention.
Figure 2:
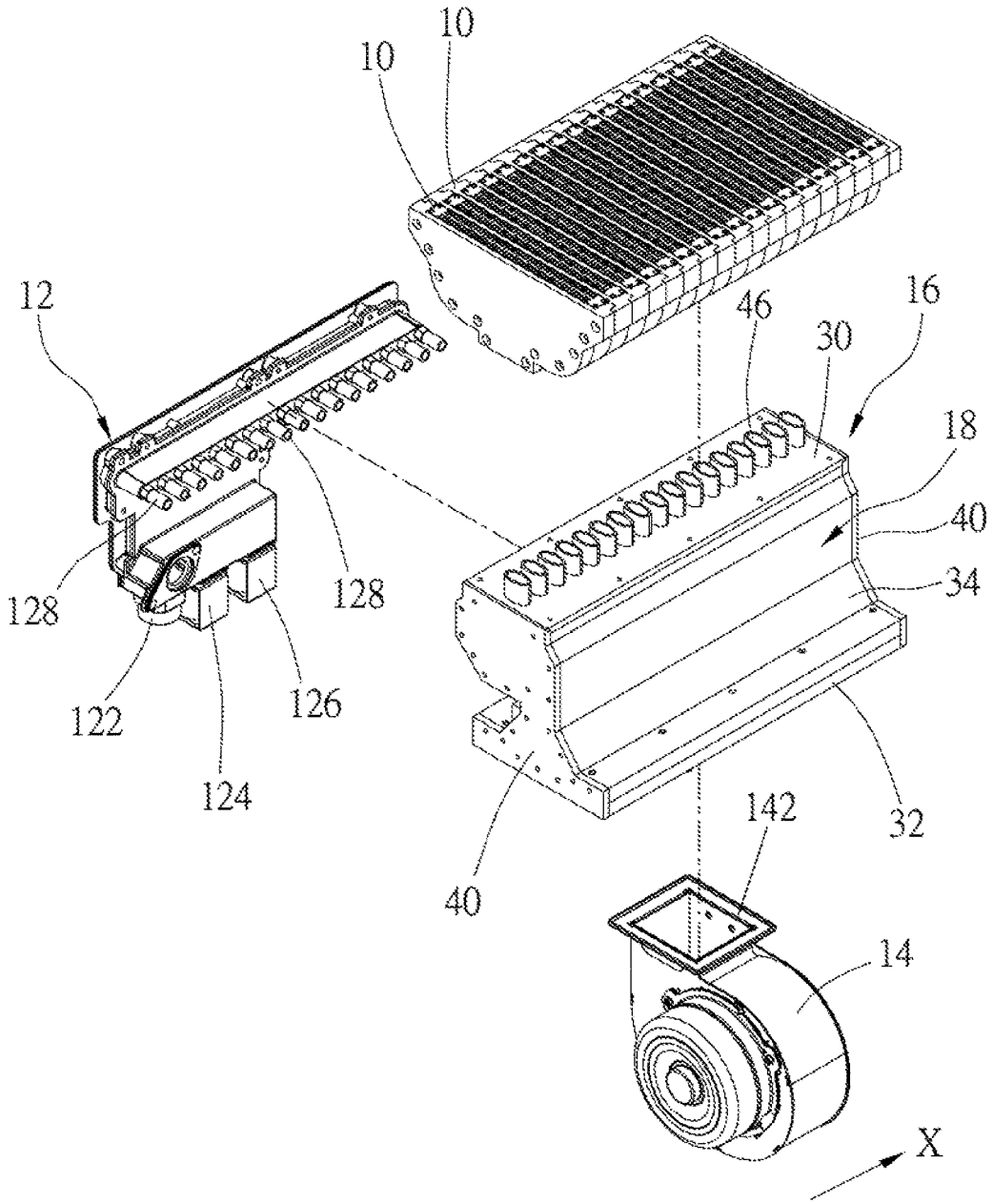
FIG. 2 is an exploded view of the gas burning device of the first embodiment.
Figure 3:
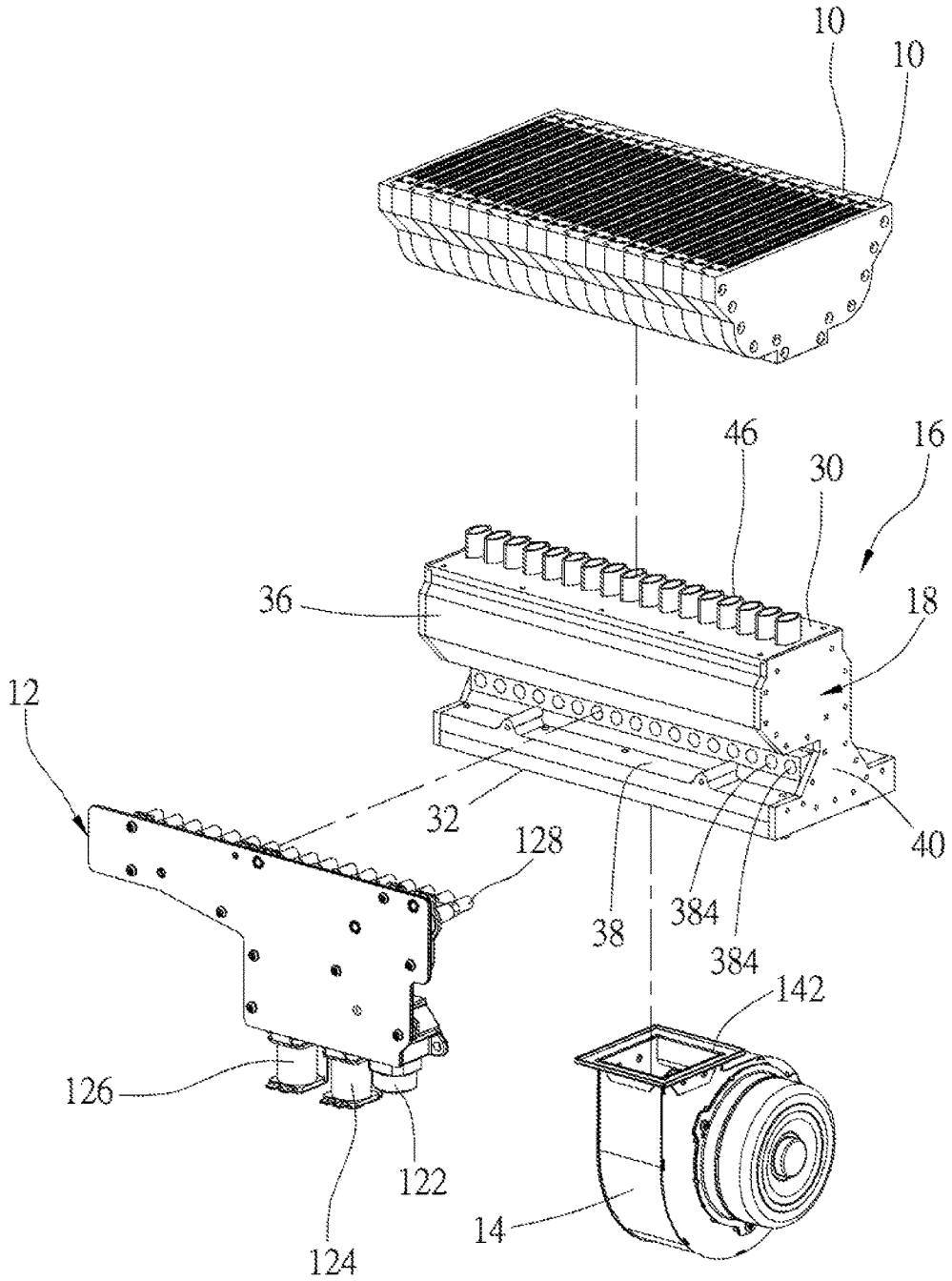
FIG. 3 is an exploded view of the gas burning device of the first embodiment seen from another perspective.

A gas burning device 100 which has a gas mixer 16 of a first embodiment of the present invention is illustrated in FIG. 1 to FIG. 10, wherein the gas burning device 100 is applied to a water heater as an example. The gas burning device 100 includes at least one burner 10, a gas inlet assembly 12, a blower 14, and the gas mixer 16 of the first embodiment.

The at least one burner 10 includes a plurality of burners 10 arranged in a predetermined axial direction X, wherein each of the burners 10 is adapted to burn gas to create flames. The gas inlet assembly 12 includes a connecting pipe 122, an electromagnetic valve 124, a proportional valve 126, and at least one nozzle 128, wherein the connecting pipe 122 is adapted to be connected to a gas source (not shown). The electromagnetic valve 124 is controllable to open or block a gas path. The proportional valve 126 is adapted to regulate a gas flow passing through the gas path. The at least one nozzle 128 includes a plurality of nozzles 128 arranged in the predetermined axial direction X, wherein the nozzles 128 are adapted to output gas. The blower 14 is adapted to draw in air and then send out the air through an outlet 142 thereof.

The gas mixer 16 includes a base 18, a flow splitter 42, at least one outlet pipe 46, and at least one partition 48.

Figure 4:
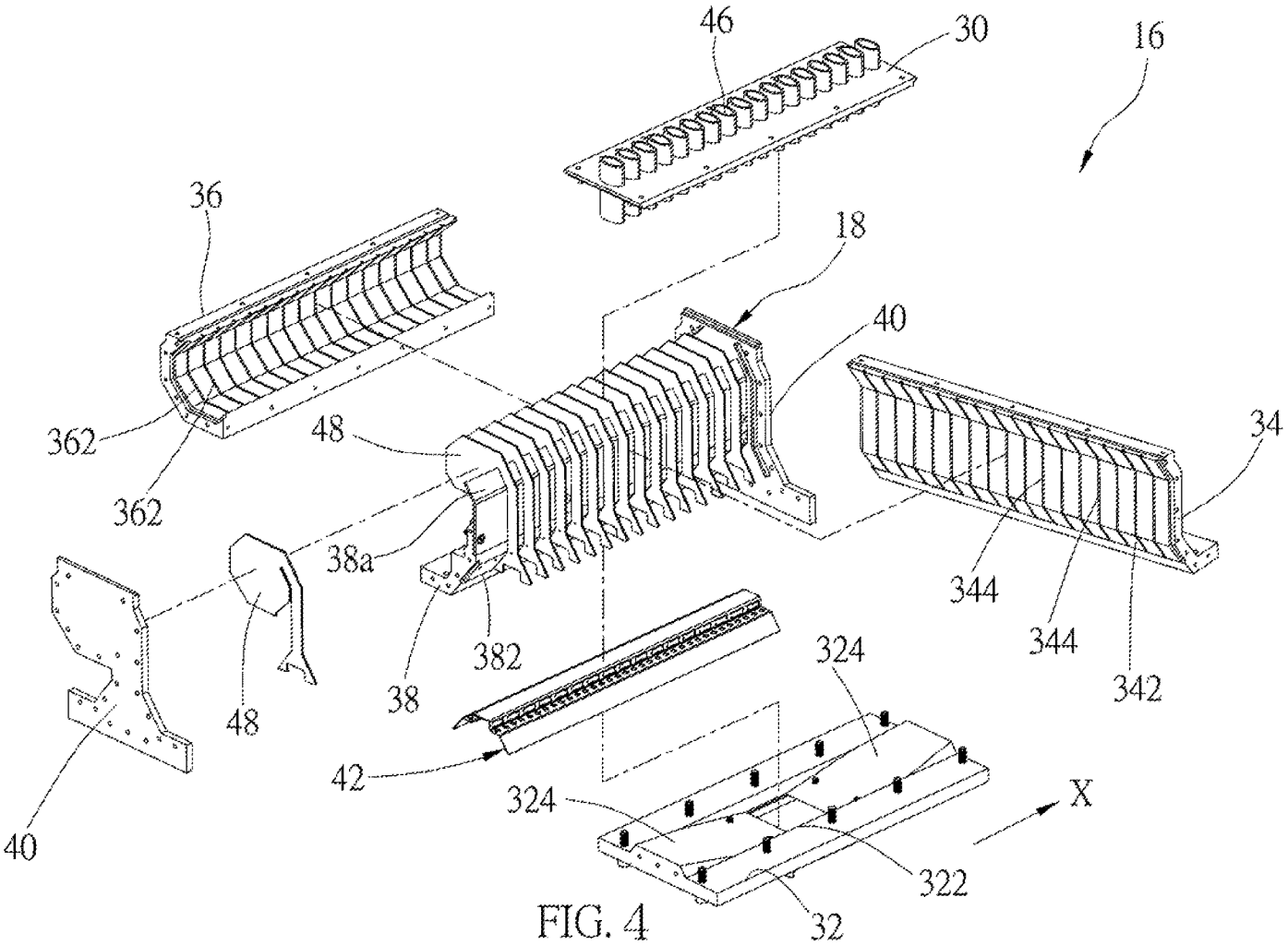
FIG. 4 is an exploded view, showing the gas mixer of the first embodiment.

The base 18 is substantially long in shape and is composed of a plurality of plates. The base 18 has an inlet portion 20 and a mixing portion 26. More specifically, as shown in FIG. 4, said plates include a top plate 30, a bottom plate 32, a front plate 34, a rear plate 36, a supporting plate 38, and two side plates 40, wherein the bottom plate 32, the front plate 34, the supporting plate 38, the side plates 40 constitute the inlet portion 20. The bottom plate 32 has an air inlet 322. In the current embodiment, the air inlet 322 is located in the middle of the bottom plate 32 in the predetermined axial direction X, wherein the air inlet 322 has at least one guiding surface 324. In the current embodiment, the at least one guiding surface 324 includes two guiding surfaces 324 located on opposite sides of the air inlet 322 in the predetermined axial direction X. Each of the guiding surfaces 324 faces upward, and is inclined in a way that, in a direction away from the air inlet 322, a distance between the guiding surfaces 324 in the predetermined axial direction X gradually increases. The blower 14 is engaged with the bottom plate 32, and the outlet 142 of the blower 14 communicates with the air inlet 322.

Figure 5:
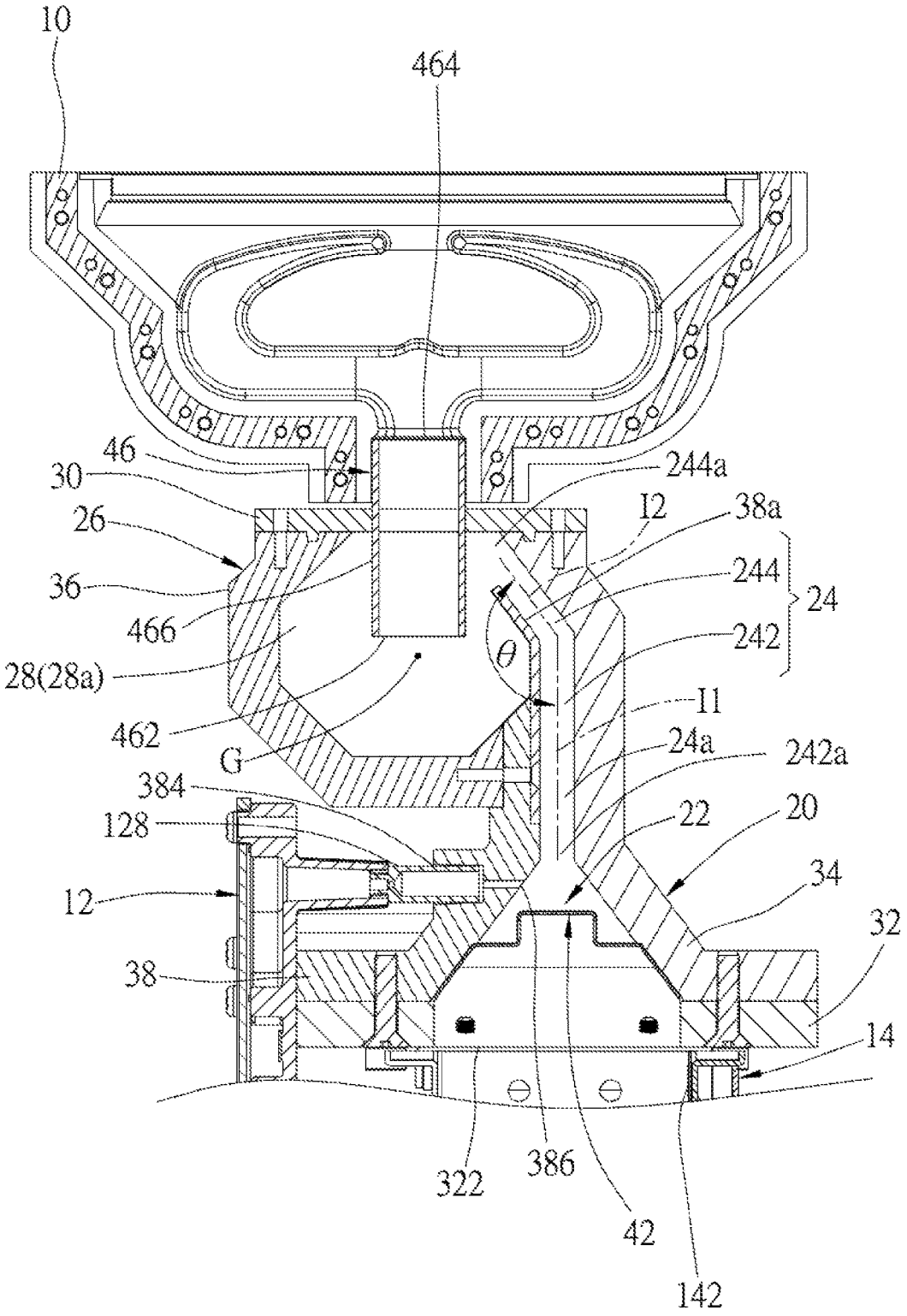
FIG. 5 is a sectional view along the 5-5 line in FIG. 1.
Figure 6:
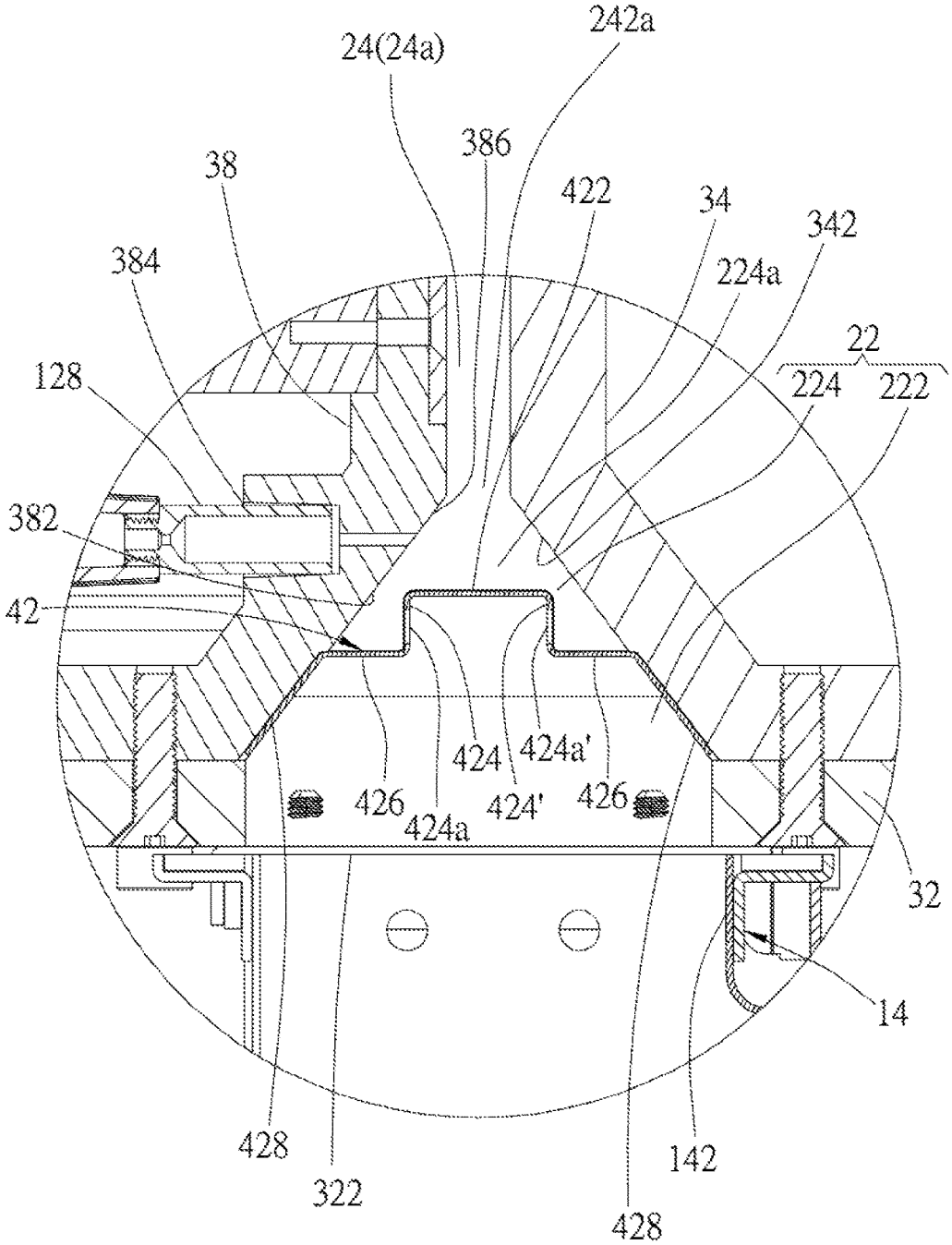
FIG. 6 is a partial enlarged view of FIG. 5.

As shown in FIG. 4 to FIG. 6, an air chamber 22 and an air path 24 are formed between the front plate 34, the bottom plate 32, and the supporting plate 38, wherein the air chamber 22 is located between the air inlet 322 and the air path 24, and communicates with the air inlet 322. Two ends of the air path 24 are respectively an opening 242*a* and an exit 244*a*. The opening 242*a* and the exit 244*a* are both long in shape. An axial direction of the opening 242*a* and an axial direction of the exit 244*a* are both parallel to the predetermined axial direction X. The opening 242*a* communicates with the air chamber 22. In the current embodiment, the air path 24 has a first section 242 and a second section 244 communicating with the first section 242, wherein the first section 242 has the opening 242*a*, and the second section 244 has the exit 244*a*. The first section 242 has a defined first reference axis I1 extending from the opening 242*a* toward the second section 244, and the second section 244 has a defined second reference axis I2 extending from the first section 242 toward the exit 244*a*. An angle θ between the first reference axis I1 and the second reference axis I2 is greater than 90 degrees, and is less than 180 degrees.

The front plate 34 has an inclined surface 342 near a bottom thereof, and the supporting plate 38 has an inclined surface 382 near a bottom thereof as well, wherein the inclined surfaces 342, 382 form two opposite walls of the air chamber 22. The opening 242*a* is formed at a top margin of the inclined surfaces 342, 382. A distance between the inclined surfaces 342, 382 gradually decreases from the air inlet 322 to the opening 242*a*. The front plate 34 has at least one groove 344. In the current embodiment, the at least one groove 344 includes a plurality of grooves 344 arranged at regular intervals in the predetermined axial direction X.

The supporting plate 38 has at least one engaging bore 384, which is adapted to be engaged with the at least one nozzle 128, and forms at least one gas inlet 386 on the inclined surface 382. In the current embodiment, the engaging bore 384 includes a plurality of engaging bores 384, and the gas inlet 386 includes a plurality of gas inlets 386, wherein the engaging bores 384 and the gas inlets 386 are arranged in the predetermined axial direction X, respectively.

The top plate 30, the rear plate 36, the side plates 40, the supporting plate 38, and a top of the front plate 34 constitute the mixing portion 26, which forms a mixing chamber 28 communicating with the exit 244*a* of the air path 24. In the current embodiment, the exit 244*a* of the air path 24 extends to the upper half of the mixing chamber 28 through a guiding plate 38*a* provided on the supporting plate 38. As shown in FIG. 5 and FIG. 6, a cross-section of the mixing chamber 28 in a direction parallel to the first reference axis I1 is a polygon, wherein a geometric center G is defined on the polygon. The top plate 30 is adapted to have the at least one outlet pipe 46 provided therethrough. The rear plate 36 has at least one groove 362. In the current embodiment, the groove 362 includes a plurality of grooves 362 corresponding to the grooves 344 of the front plate 34.

Figure 7:
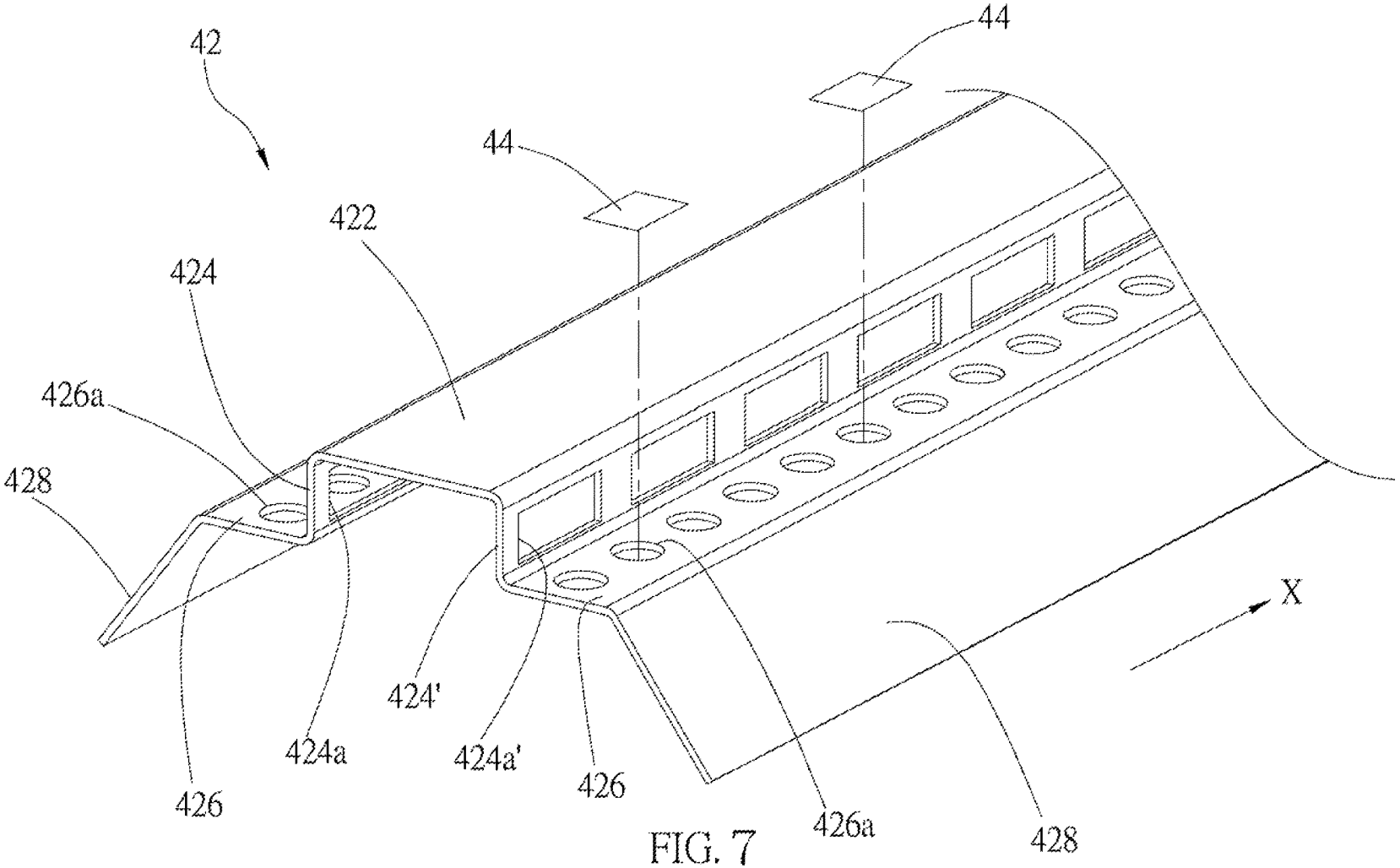
FIG. 7 is a partial perspective view, showing the flow splitter of the first embodiment.
Figure 8:
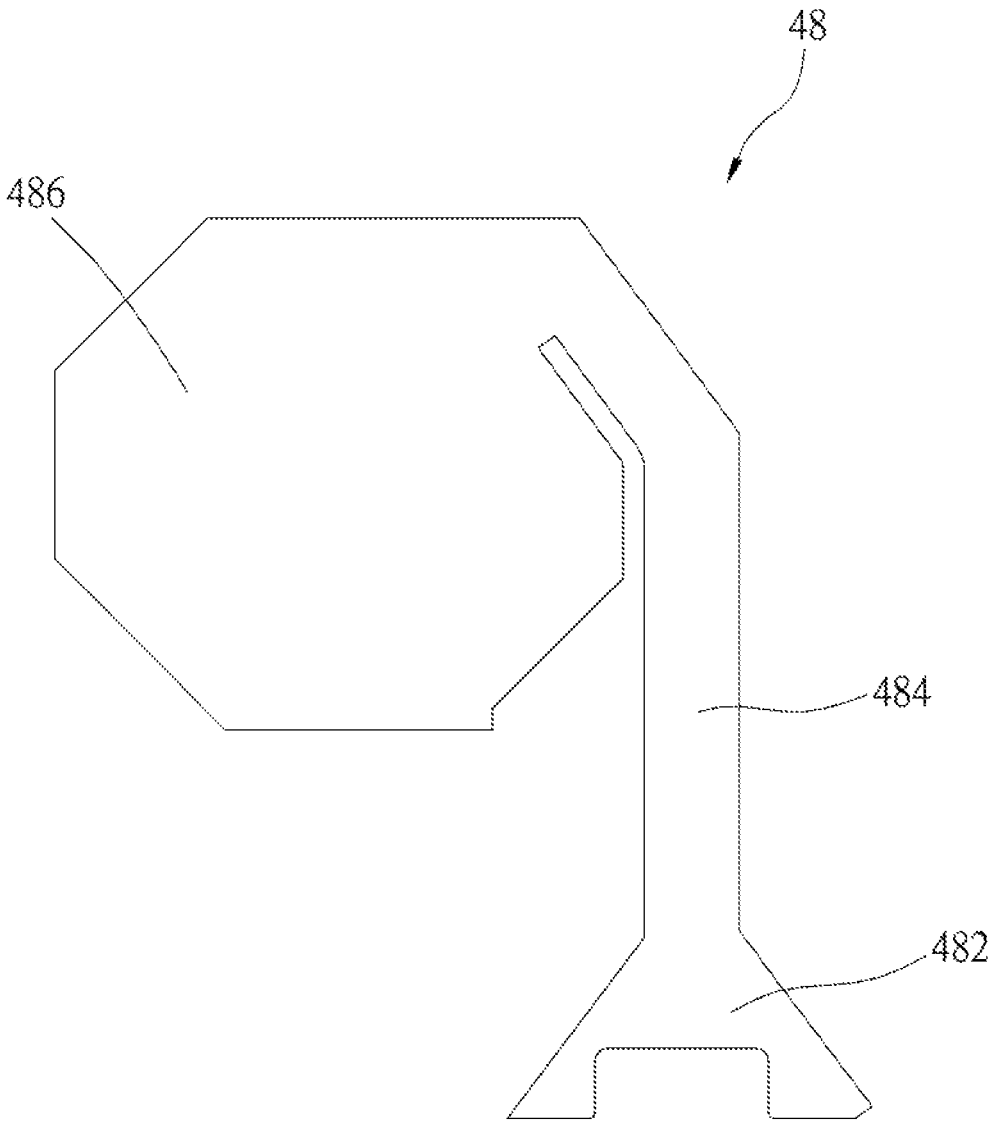
FIG. 8 is a side view, showing the partition of the first embodiment.

The flow splitter 42 is provided in the air chamber 22 of the inlet portion 20 of the base 18, and is located between the gas inlets 386 and the air inlet 322. The flow splitter 42 divides the air chamber 22 into a first space 222 and a second space 224, wherein the first space 222 communicates with the air inlet 322, and the guiding surface 324 of the bottom plate 32 corresponds to the first space 222. The second space 224 communicates with the opening 242*a* and the gas inlets 386. As shown in FIG. 7, in the current embodiment, the flow splitter 42 is long in shape, and includes a closed end which is a flat plate 422 as an example, two vertical plates 424, 424', two middle plates 426, and two inclined plates 428, wherein the flat plate 422 faces the opening 242*a*. The vertical plates 424, 424' are respectively connected to two opposite lateral edges of the flat plate 422, and faces the inclined surface 342 of the front plate 34 and the inclined surface 382 of the supporting plate 38, respectively. The vertical plate 424 has at least one through hole 424*a* facing the inclined surface 382 of the supporting plate 38. In the current embodiment, the at least one through hole 424*a* includes a plurality of through holes 424*a* arranged in the predetermined axial direction X. The another vertical plate 424' has a plurality of through holes 424*a'* arranged in the predetermined axial direction X, wherein the through holes 424*a'* face the inclined surface 342 of the front plate 34 (i.e., the wall opposite to the gas inlets 386). The first space 222 communicates with the second space 224 through the through holes 424*a*, 424*a'*. Each of the middle plates 426 is located between a side of one of the vertical plates 424, 424' and the corresponding one of the inclined surfaces 342, 382. Each of the inclined plates 428 is respectively connected to a side of one of the middle plates 426, and respectively abuts against the corresponding one of the inclined surfaces 342, 382. A sum of cross-sectional areas of the through holes 424*a*, 424*a'* is preferably greater than or equal to a cross-sectional area of the air inlet 322, whereby to reduce a reverse pressure generated when the blower 14 outputs the airflow.

In the current embodiment, each of the middle plates 426 has a plurality of splitting holes 426*a* arranged in the predetermined axial direction X. A plurality of closing members 44 are detachably provided on the middle plates 426, wherein the closing members 44 are adapted to be optionally used to close at least a part of the splitting holes 426*a*. In practice, the closing members 44 could be made of a metal sheet such as foil tape. The airflow flowing from the first space 222 into the second space 224 passes mainly through the through holes 424*a*, 424*a'*, and the splitting holes 426*a* are adapted to regulate the airflow. For areas with stronger airflow, the splitting holes 426*a* thereof could be sealed by the closing members 44. In practice, the splitting holes 426*a* on the middle plates 426 could be also omitted.

The at least one outlet pipe 46 is provided in the mixing portion 26 of the base 18. More specifically, the at least one outlet pipe 46 passes through the top plate 30, and the at least one outlet pipe 46 includes a plurality of outlet pipes 46 arranged in the predetermined axial direction X. An axial direction of each of the outlet pipes 46 is parallel to the first reference axis I1 of the first section 242 of the air path 24. Each of the outlet pipes 46 has a first end 462, a second end 464, and a body 466 located between the first end 462 and the second end 464, wherein the first end 462 and part of the body 466 extend into the mixing chamber 28, and the first end 462 is near a center of the mixing chamber 28. Preferably, the first end 462 is located at a height between ¼ to ¾ a longitudinal length of the mixing chamber 28. The second end 464 communicates with the burners 10, and the exit

244*a* of the air path 24 corresponds to the body 466. As mentioned above, the cross-section of the mixing chamber 28 in the direction parallel to the first reference axis I1, i.e., parallel to the axial direction of each of the outlet pipes 46, is a polygon, which has the geometric center G defined therein. Said polygon is an octagon in the current embodiment. However, it is not limited to be an octagon as exemplified above, but could be a triangle or even a circle. The first end 462 of each of the outlet pipes 46 is near the geometric center G of the polygon and is located between the exit 244*a* of the air path 24 and the geometric center G. The mixing chamber 28 communicates with the burners 10 through the outlet pipes 46. The ratio of the sum of a minimum cross-sectional area of each of the outlet pipes 46 to the minimum cross-sectional area of the air path 24 is between 1.2 and 0.8.

As shown in FIG. 4 to FIG. 6, and FIG. 8, the at least one partition 48 is provided on the base. In the current embodiment, the at least one partition 48 includes a plurality of partitions 48 arranged in the predetermined axial direction X. Each of the partitions 48 includes a first portion 482 located in the second space 224, a second portion 484 located in the air path 24, and a third portion 486 located in the mixing chamber 28, wherein each of the partitions 48 fits into one of the groove 362 of the rear plate 36 and one of the groove 344 of the front plate 34 in a way that the partitions 48 have regular intervals. The first portions 482 of the partitions 48 divide the second space 224 into a plurality of sub-spaces 224*a*, the second portions 484 of the partitions 48 divide the air path 24 into a plurality of air sub-paths 24*a*, and the third portions 486 of the partitions 48 divide the mixing chamber 28 into a plurality of mixing sub-chambers 28*a*. Each of the mixing sub-chambers 28*a* has at least one of the outlet pipes 46 provided therein. Each of the sub-spaces 224*a* communicates with at least one of the through holes 424*a* and at least one of the gas inlets 386.

Figure 9:
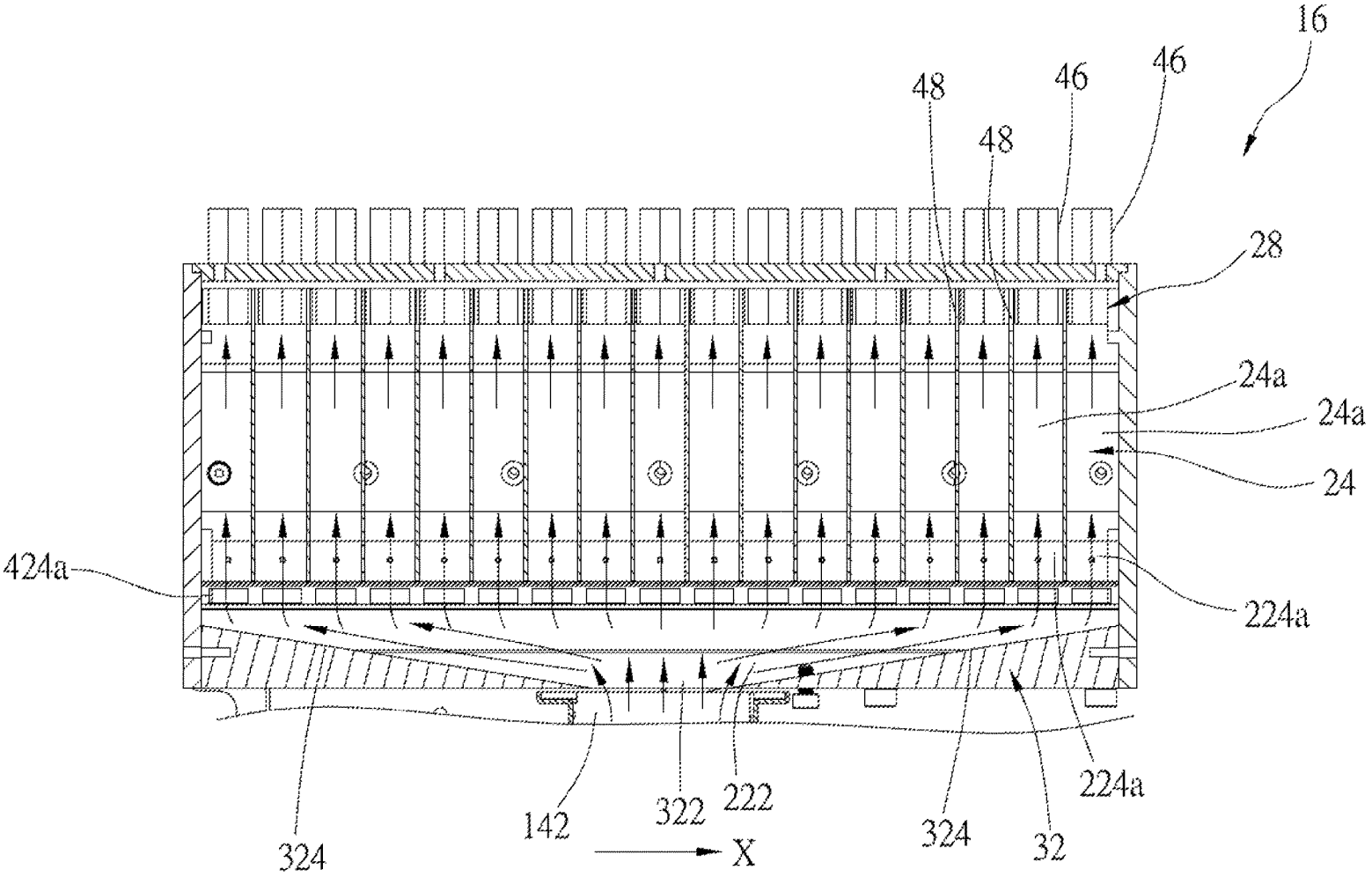
FIG. 9 is a sectional schematic diagram, showing the airflow flowing in the gas mixer.
Figure 10:
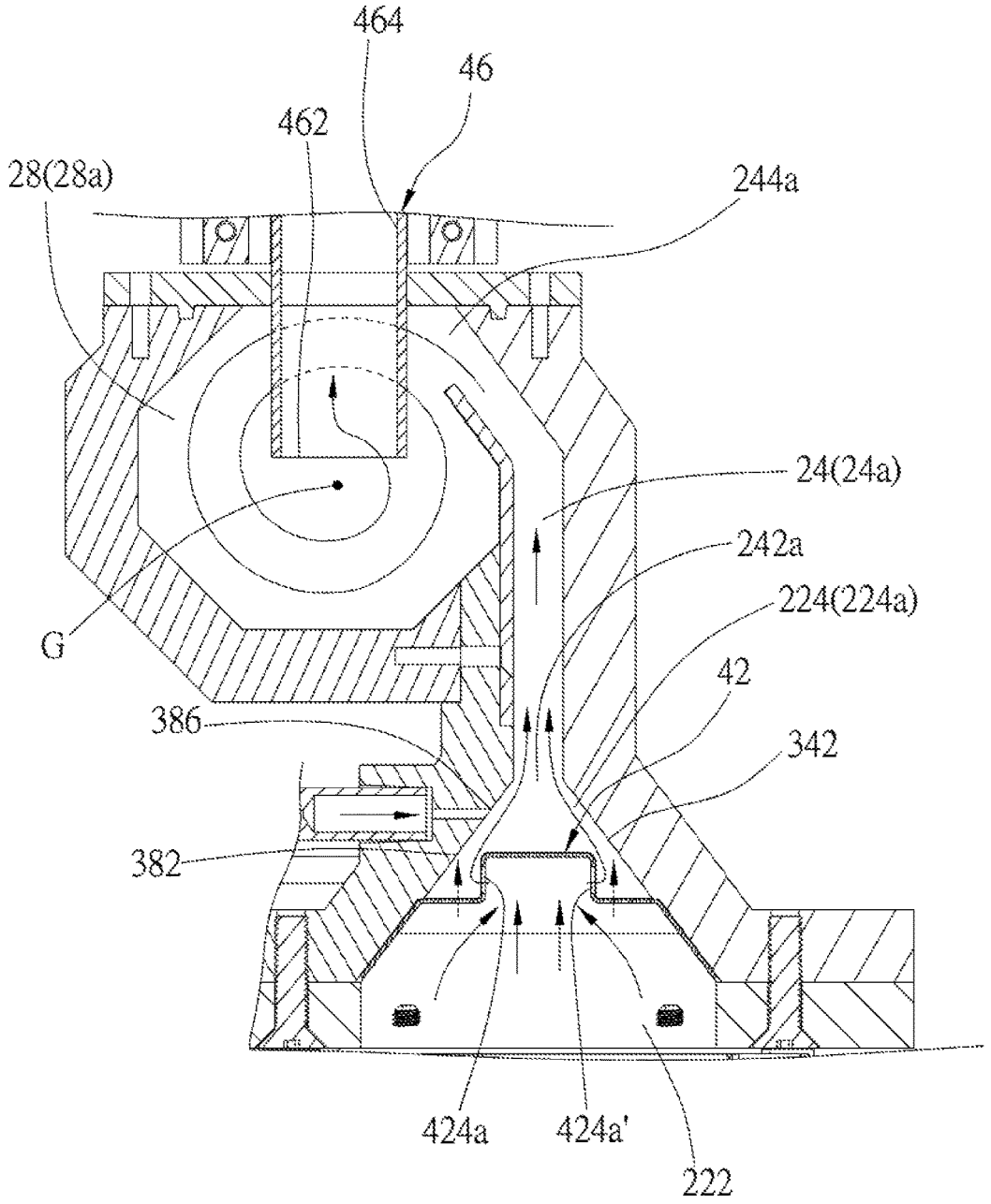
FIG. 10 is another sectional schematic diagram, showing the airflow flowing in the gas mixer.

How the gas mixer 16 of the present embodiment mixes gas and air is illustrated in FIG. 9 and FIG. 10. As shown in FIG. 9, when the air outputted by the outlet 142 of the blower 14 is injected into the first space 222 of the air chamber 22 through the air inlet 322, part of the airflow goes upward, and another part of the airflow flows to two sides of the air inlet 322 along the two guiding surfaces 324. Whereby, the airflow would enter the region in the first space 222 on two sides of the air inlet 322, rather than just concentrate above of the air inlet 322.

As shown in FIG. 10, the airflow flows into the second space 224 through the through holes 424*a*, 424*a*' of the flow splitter 42, wherein the flow splitter 42 could prevent the airflow from forming a vortex which may hinder the traveling of the airflow. In the case that the splitting holes 426*a* are not sealed, part of the airflow would flow into the second space through the splitting holes 426*a*. Since the second space 224 is divided into a plurality of sub-spaces 224*a*, the airflow in the sub-spaces 224*a* would not interfere with each other, so that the airflow could flow smoothly. The airflow in the sub-spaces 224*a* would be guided by the two inclined surfaces 342, 382 to flow upward along the inclined surfaces 342, 382, which could reduce the occurrence of turbulence. When the airflow passes through the gas inlet 386, the gas flow would be drawn upward as well, wherein the airflow and the gas flow would enter the opening 242*a* together. After that, the airflow and the gas flow would pass through the air sub-paths 24*a*, and get into the mixing sub-chambers 28*a* through the exit 244*a*. Since the exit 244*a* is located at the outermost periphery of the mixing sub-chambers 28*a*, the airflow and the gas flow would rotate along the wall of the mixing sub-chambers 28*a*, and move toward the geometrical center G of the polygon gradually. In this way, the airflow and the gas flow could be fully mixed in the mixing sub-chambers 28*a*. In the mixing sub-chambers 28*a*, the flow rate of the airflow closer to the outermost periphery is high and the pressure there is low; on the contrary, the flow rate closer to the geometric center G is lower and the pressure there is high, which would facilitate the mixture. Therefore, by providing the first ends 462 of the outlet pipes 46 near the geometric center G (i.e., near the center of the mixing chamber 28), the mixed airflow and the gas flow with high pressure could easily enter the outlet pipes 46 through the first ends 462, and then be outputted into the burners 10 through the second ends 464 for combustion.

In addition, the ratio of the sum of the minimum cross-sectional areas of the outlet pipes 46 to the minimum cross-sectional areas of the air path 24 is between 1.1 and 0.9. In other words, the pressure in the air path 24 would be close to the pressure in the outlet pipes 46, and therefore, when the amount of the airflow outputted from the blower 14 and the amount of gas injected through the gas inlet 386 are varied, the amount of air and the amount of gas coming out from the outlet pipes 46 would vary accordingly and rapidly, which would shorten the reaction time for adjusting the flame height of the burners 10.

Figure 11:
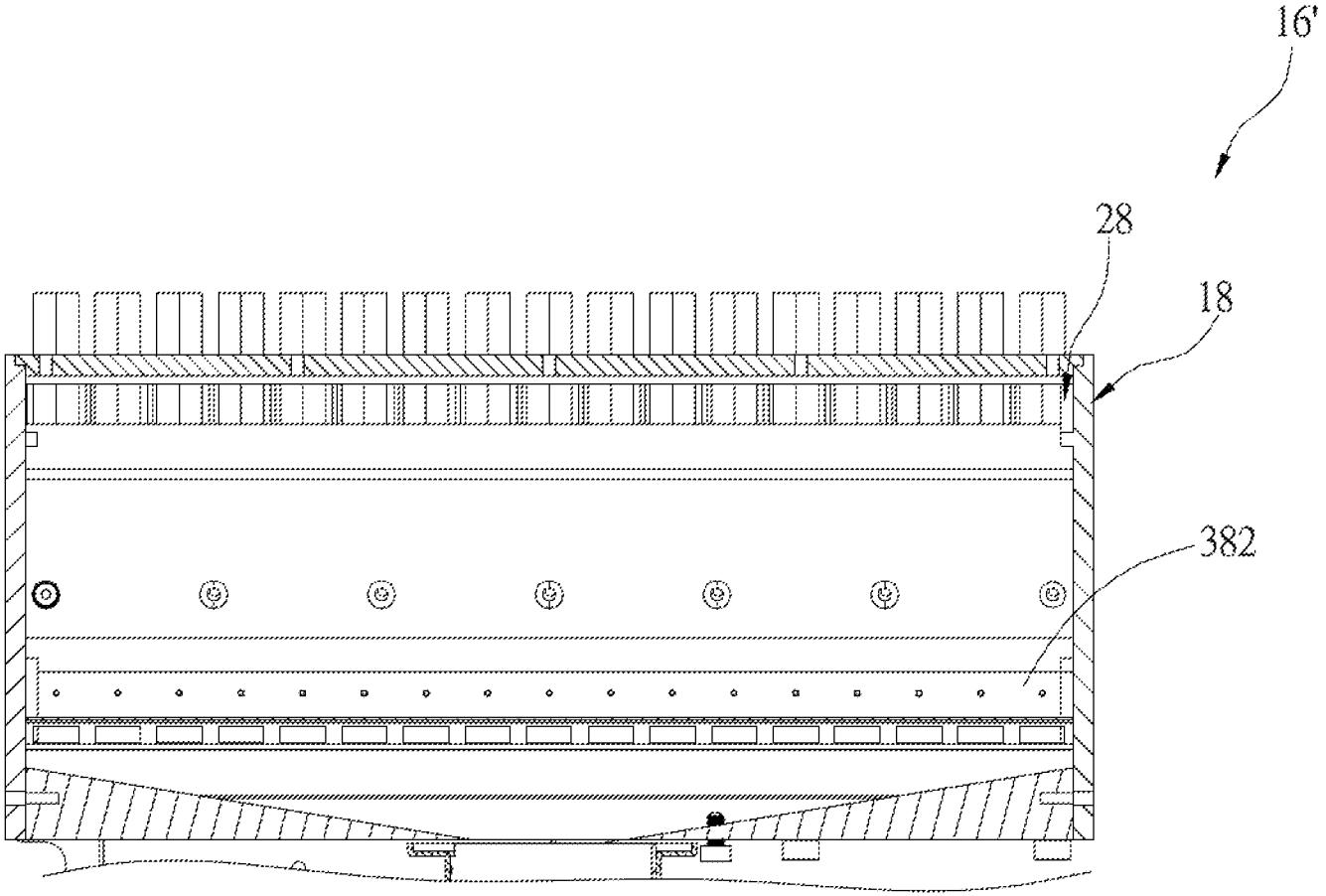
FIG. 11 is a sectional schematic diagram of the gas mixer of a second embodiment of the present invention.

As illustrated in FIG. 11, a gas mixer 16' of a second embodiment of the present invention has almost the same structure as said gas mixer 16 of the first embodiment, except that a base 18 in the second embodiment has no partition 48 provided therein. Although the partition 48 is omitted in the current embodiment, the airflow and the gas flow could still be fully mixed through the mixing chamber 28 and the two inclined surfaces of the air chamber 24 (only one of the inclined surfaces, i.e., the inclined surface 382, is shown in FIG. 11; the other one is not shown).

Figure 12:
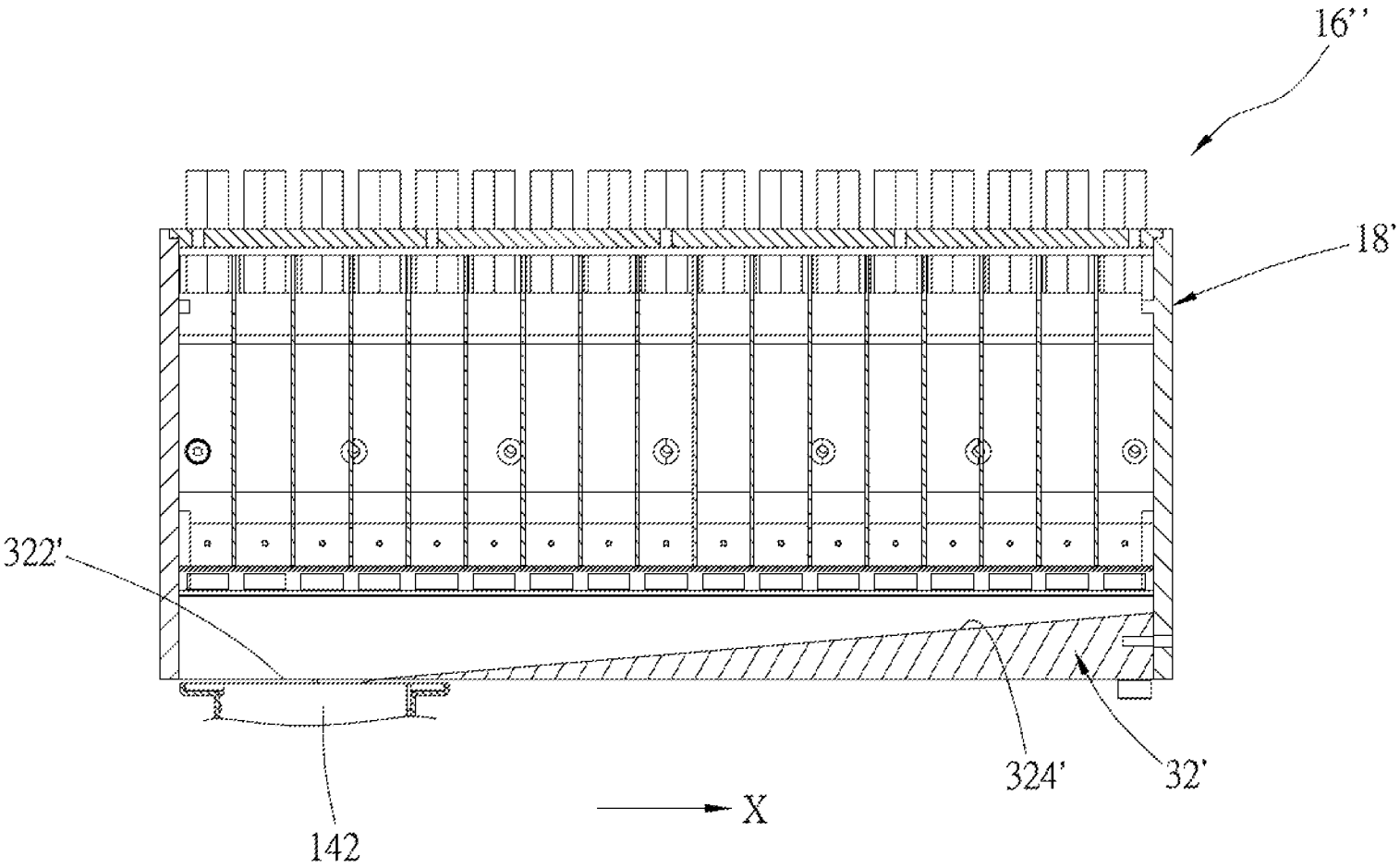
FIG. 12 is a sectional schematic diagram of the gas mixer of a third embodiment of the present invention.

As illustrated in FIG. 12, a gas mixer 16" of a third embodiment of the present invention has almost the same structure as said gas mixer 16 of the first embodiment, except that an air inlet 322' on a bottom plate 32' of a base 18' is located on a side of a center of the bottom plate 32' in the predetermined axial direction X. A guiding surface 324' of the bottom plate 32' faces upward, and is also inclined in such a way mentioned in the first embodiment, wherein, in a direction away from the air inlet 322', a distance between the guiding surfaces 324' in the predetermined axial direction X gradually increases.

In conclusion, the gas mixer of the present invention could effectively premix air and gas, whereby to enhance the combustion efficiency of the burner and shorten the reaction time for adjusting the flame height of the burner.

It must be pointed out that the embodiments described above are only some preferred embodiments of the present invention. All equivalent structures which employ the concepts disclosed in this specification and the appended claims should fall within the scope of the present invention.

What is claimed is:

1. A gas mixer, which is adapted to communicate with at least one burner, comprising:

a base having an inlet portion and a mixing portion, wherein the inlet portion has an air inlet, an air chamber, at least one gas inlet, and an opening, which communicate with each other; the air chamber is located between the air inlet and the opening, and has two opposite walls; the walls are inclined, and a distance between the walls gradually decreases in a direction from the air inlet to the opening; the gas inlet is located on one of the walls; the mixing portion has a mixing chamber communicating with the opening, and is also adapted to communicate with the burner; and a flow splitter provided in the air chamber and located between the gas inlet and the air inlet, wherein the flow splitter divides the air chamber into a first space and a second space; the first space communicates with the air inlet, and the second space communicates with the opening and the gas inlet; the flow splitter has at least one through hole facing one of the walls, and the first space communicates with the second space through the at least one through hole.

2. The gas mixer of claim 1, further comprising at least one outlet pipe engaged with the mixing portion of the base, wherein each of the at least one outlet pipe has a first end and a second end; the first end extends into the mixing chamber, and the second end is adapted to communicate with the burner.

3. The gas mixer of claim 2, wherein each of the at least one outlet pipe has a body located between the first end and the second end; part of the body is located in the mixing chamber; the inlet portion has an air path; an end of the air path has the opening, while another end thereof has an exit communicating with the mixing chamber; the exit corresponds to the body.

4. The gas mixer of claim 3, wherein the at least one outlet pipe comprises a plurality of outlet pipes arranged in a predetermined axial direction; an axial direction of the opening and an axial direction of the exit are parallel to the predetermined axial direction.

5. The gas mixer of claim 4, wherein the air path has a first section and a second section communicating with the first section; the first section has the opening, and the second section has the exit; the first section has a defined first reference axis extending from the opening toward the second section, and the second section has a defined second reference axis extending from the first section toward the exit, wherein the first reference axis is parallel to the axial direction of each of the outlet pipes; an angle between the first reference axis and the second reference axis is greater than 90 degrees, and is less than 180 degrees.

6. The gas mixer of claim 4, wherein the flow splitter comprises a closed end and a vertical plate connected to a lateral edge of the closed end; the closed end faces the opening; the at least one gas inlet comprises a plurality of gas inlets arranged in the predetermined axial direction; the at least one through hole comprises a plurality of through holes arranged in the predetermined axial direction; the vertical plate has the through holes, and faces one of the walls having the gas inlets.

7. The gas mixer of claim 6, wherein the flow splitter comprises another vertical plate connected to another lateral edge of the closed end; the another vertical plate has a plurality of through holes arranged in the predetermined axial direction; the another vertical plate faces one of the walls opposite to the gas inlets.

8. The gas mixer of claim 7, wherein the flow splitter comprises two middle plates; each of the middle plates is located between a side of one of the vertical plates and the corresponding one of the walls; each of the middle plates has a plurality of splitting holes.

9. The gas mixer of claim 8, further comprising a plurality of closing members optionally engaged with each of the middle plates to close at least a part of the splitting holes.

10. The gas mixer of claim 6, wherein the base comprises a bottom plate having the air inlet and at least one guiding surface corresponding to the first space; the at least one guiding surface faces upward, and is inclined from the air inlet.

11. The gas mixer of claim 10, wherein the at least one guiding surface comprises two guiding surfaces located on two opposite sides of the air inlet in the predetermined axial direction.

12. The gas mixer of claim 10, wherein the air inlet is located on a side of a center of the bottom plate in the predetermined axial direction.

13. The gas mixer of claim 10, further comprising at least one partition provided on the base; the at least one partition comprises a first portion located in the second space, a second portion located in the air path, and a third portion located in the mixing chamber, wherein the first portion divides the second space into a plurality of sub-spaces; the second portion divides the air path into a plurality of air sub-paths; the third portion divides the mixing chamber into a plurality of mixing sub-chambers.

14. The gas mixer of claim 13, wherein the at least one partition comprises a plurality of partitions arranged in the predetermined axial direction; each of the mixing sub-chambers has at least one of the outlet pipes provided therein; each of the sub-spaces communicates with at least one of the through holes and at least one of the gas inlets.

15. The gas mixer of claim 4, wherein a ratio of a sum of minimum cross-sectional areas of the outlet pipes to the minimum cross-sectional area of the air path is between 1.2 and 0.8.

16. The gas mixer of claim 3, wherein the first end of each of the at least one outlet pipe is near a center of the mixing chamber.

17. The gas mixer of claim 3, wherein a cross-section of the mixing chamber in a direction parallel to the first reference axis is a polygon; the first end of each of the at least one outlet pipe is near a geometric center of the polygon.

18. The gas mixer of claim 17, wherein the first end of each of the at least one outlet pipe is located between the exit and the geometric center of the polygon.

* * * * *